United States Patent [19]

Cochran

[11] Patent Number: 4,618,059

[45] Date of Patent: Oct. 21, 1986

[54] DIVIDER FOR SEPARATING STACKED ARTICLES

[75] Inventor: James A. Cochran, Burlington, N.C.

[73] Assignee: Burlington Industries, Inc., Greensboro, N.C.

[21] Appl. No.: 476,381

[22] Filed: Mar. 17, 1983

[51] Int. Cl.[4] ..... B65D 85/676; B65D 85/04; B65D 21/02

[52] U.S. Cl. ..... 206/392; 206/427; 206/511

[58] Field of Search ..... 206/392, 427, 511, 516; 220/21

[56] References Cited

U.S. PATENT DOCUMENTS

| | | | |
|---|---|---|---|
| D. 150,496 | 8/1948 | Erickson . | |
| D. 180,396 | 6/1957 | Emery . | |
| D. 217,594 | 5/1970 | Bardell . | |
| D. 236,326 | 8/1975 | Trebilcock . | |
| 1,331,862 | 2/1920 | Claus | 206/511 |
| 1,941,941 | 1/1934 | Irwin | 206/511 |
| 2,570,340 | 10/1951 | George . | |
| 2,699,866 | 1/1955 | Russell, Jr. . | |
| 2,749,705 | 3/1956 | Pritchett et al. . | |
| 2,860,825 | 11/1958 | Montgomery et al. . | |
| 3,009,579 | 11/1961 | Ettlinger, Jr. . | |
| 3,332,574 | 7/1967 | Earp | 220/21 |
| 3,333,727 | 8/1967 | Belcher | 220/21 |
| 3,335,858 | 8/1967 | Sibille . | |
| 3,375,919 | 4/1968 | Schlager et al. . | |
| 3,765,539 | 10/1973 | Boyle . | |
| 3,982,654 | 9/1976 | Gottsegen | 206/427 |
| 4,042,108 | 8/1977 | Brethauer . | |
| 4,142,634 | 3/1979 | Leff et al. . | |

FOREIGN PATENT DOCUMENTS

| | | | |
|---|---|---|---|
| 517108 | 10/1955 | Canada | 206/392 |
| 1004725 | 4/1952 | France | 206/392 |

*Primary Examiner*—George E. Lowrance

*Attorney, Agent, or Firm*—Cushman, Darby & Cushman

[57] ABSTRACT

A divider for separating stacked articles, particularly yarn spools, includes a substantially rigid planar member in which plural apertures, preferably having the shape and arrangement as shown in FIG. 1, are defined so that the divider is capable of accommodating various diameters of yarn spools, for example.

13 Claims, 6 Drawing Figures

DIVIDER FOR SEPARATING STACKED ARTICLES

BACKGROUND AND SUMMARY OF THE INVENTION

1. Introduction

The present invention generally relates to packaging systems and, more particularly, to dividers or separator sheets for separating stacked articles, in a packaging container for example, so as to prevent damage to such articles during shipment thereof while yet permitting maximum use of the available space in the container.

Typically, long filaments of yarn are wound around a tube or a conical-shaped core member to form yarn spools which are thereafter transported to processing areas where the yarn is unwound from the spool and processed into finished textile goods. While the diameters of the tubes and cones utilized as the cores around which the yarn is wound are typically industry-standardized sizes, the nominal diameters of the spools can be any predetermined size depending upon the quantity of yarn that is wound around the core member.

Conventional practice is to supply yarn spools to textile manufacturing facilities having diameters between about 5 inches to about 14 inches and typically spool sizes of about 5, 7, 9, 12 and 14 inches in diameter are offered. Accordingly, textile manufactures may require differing quantities of yarn and thus various yarn product spool sizes may be required to be shipped and/or transported simultaneously in a single container.

In accordance with the present invention, such versatility is provided by the separator sheet which universally accepts various yarn spool sizes (e.g. diameters) by establishing predetermined spatial groupings of apertures therein. Thus, the separator sheet of the present invention permits stacked separation in a container between, for example, a layer of yarn spools having one diameter and a second layer of yarn spools having a diameter differing from that of the spools in the adjacent layer. In such a manner, the interior volume of the container is utilized to a maximum extent for shipping and/or transportation purposes while the yarn spools themselves are securely protected to avoid damage thereto during movement.

2. Background Information

It generally has been the conventional practice in the textile industry to provide cardboard or boxboard separator sheets for separating stacked yarn spools in a container which include perforated openings or the like therein through which a portion of the tube extends. In this regard, the reader's attention is directed to U.S. Pat. Nos. 2,699,866 to Russell, Jr.; 2,739,705 to Pritchett et al; and 2,860,825 to Montgomery et al. There have also been proposals to utilize rigid lightweight materials, such as molded plastics, as dividers for stackable yarn spools as evidenced by U.S. Pat. Nos. 4,042,108 to Brethauer; 3,375,919 to Schlager et al; 3,335,858 to Sibille; and Des. 180,396 to Emery.

However, all of the above proposals are limited in practical application since they only accommodate one diameter of yarn spools. Accordingly, should various diameters of yarn spools be required, each would necessitate its own spatial arrangement of perforated openings or other core engaging members. Accordingly, storage of such various separator sheets would tend to be a problem as they would need to be segregated according to the product sizes which they accommodate and, more importantly, would not be fungible in the sense that a separator sheet for one yarn spool size would not be suitable for other yarn spool sizes. Thus, uniformity and interchangeability are lacking with respect to the above prior proposals.

U.S. Pat. No. 3,765,539 to Boyle (the disclosure thereof being expressly incorporated hereinto by reference) discloses that a separator platform having groups of projections extending outwardly therefrom can be utilized to accommodate spools of different sizes. However, since the separator of Boyle utilizes relatively monolithic raised projections as the means for receivably holding the yarn spools, the separator thereof may be rather cumbersome for workmen to handle and, moreover, could increase shipping and/or transportation costs owing to the monolithic nature of the separator and its suspected increased weight.

The reader may also wish to refer to the following United States Patents to glean further background information regarding this invention: U.S. Pat. Nos. 2,570,340 to George; 3,009,579 to Ettlinger, Jr.; 4,142,634 to Leff et al; Des. 150,496 to Erickson; Des. 217,594 to Bardell; and Des. 236,326 to Trebilcock.

3. Brief Summary

Briefly stated, the present invention comprises a substantially rigid planar support member having separate groupings of symmetrically defined apertures therein so as to accommodate various yarn spool diameters so as to efficiently utilize the available space in a shipping container. Additionally, the present invention provides nesting capabilities by including a ball and socket arrangement whereby the ball of one support member will registrably mate with a socket defined in another support member continuously nested therewith to promote storage of the platforms during nonuse and to prevent relative sliding movement thereof when in a nested relationship.

The primary advantage of the present invention, therefore, is that only one type of yarn spool separator or divider need be utilized so as to accommodate all typical yarn spool diameters. Accordingly, the present invention is extremely versatile in that various yarn spool product sizes can be accommodated on a single separator sheet as desired thereby eliminating the prior practice of maintaining segregated inventories of separator sheets each of which corresponds to a different yarn spool product size.

These advantages of the present invention, as well as others, will become more clear to the reader after careful consideration is given to the following detailed description of the preferred exemplary embodiment thereof.

BRIEF DESCRIPTION OF THE ACCOMPANYING DRAWING

Reference will hereinafter be made to the accompanying drawings wherein like reference numerals throughout the various figures denote like elements and wherein.

DETAILED DESCRIPTION OF THE PREFERRED EXEMPLARY EMBODIMENT

It can be seen in the accompanying drawings that divider 10 is preferably a substantially planar member constructed of a suitable lightweight rigid material. Preferably, rigid molded plastic is utilized to form divider 10 although other substantially rigid lightweight materials such as aluminum, corrugated box board, or the like could also advantageously be utilized. Although divider 10 could be substantially solid between the apertures formed therein, I prefer to utilize a grid-like array of interconnecting ribs 12. By utilizing ribs 12, sufficient structural rigidity is achieved while the overall weight of divider 12 is reduced. Such weight reduction is not only advantageous from a transportation cost viewpoint but is also advantageous from a workman's viewpoint since divider 10 is more easily manipulated.

Floorspace in a textile mill, factory, warehouse or the like is extremely valuable and thus it is common practice in such areas to stack items to conserve as much space as possible. However, the more items that are stacked with one another, the greater the potential is for items to laterally move relative to one another due to common vibrations from vehicles, machinery or the like, for example. Thus, the potential exists that the stacked items could collapse and injure workmen.

Figure 2:
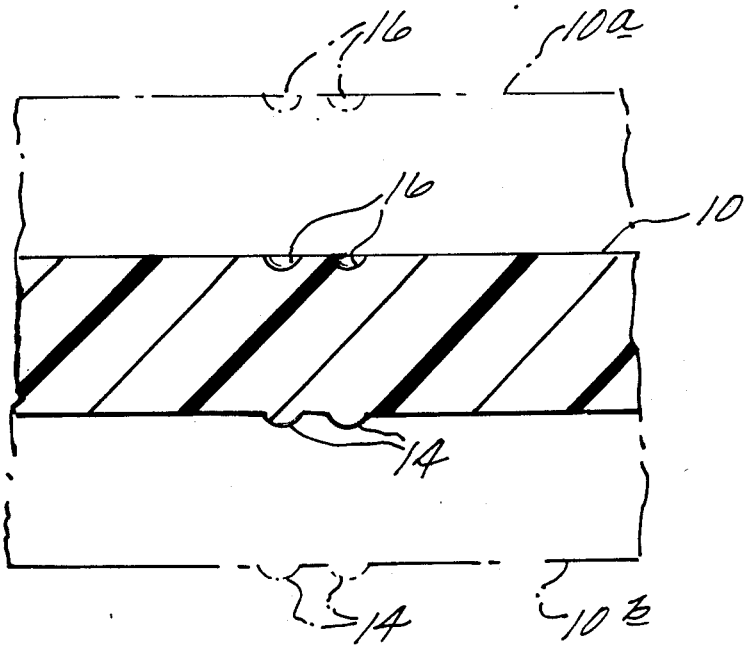
FIG. 2 is a cross sectional view taken along line 2—2 in FIG. 1.

To prevent movement of divider 10 when it is contiguously stacked or nested with other like dividers, I provide pairs of raised surfaces 14 on the bottom of divider 10 which engageably register with recesses 16 formed on the top of a contiguously nested divider (see FIG. 2). Raised surfaces 14 and recesses 16 form a matable ball and socket arrangement when plural dividers 10, 10*a* and 10*b* are contiguously nested with one another so as to prevent transverse movement of one divider relative to the others. Thus, secure stacking capability is provided according to the present invention through the use of raised surfaces 14 and recesses 16. Preferably, surfaces 14 and recesses 16 are arcuately convex and concave, respectively, although other geometric configurations could be advantageously utilized.

Figure 1:
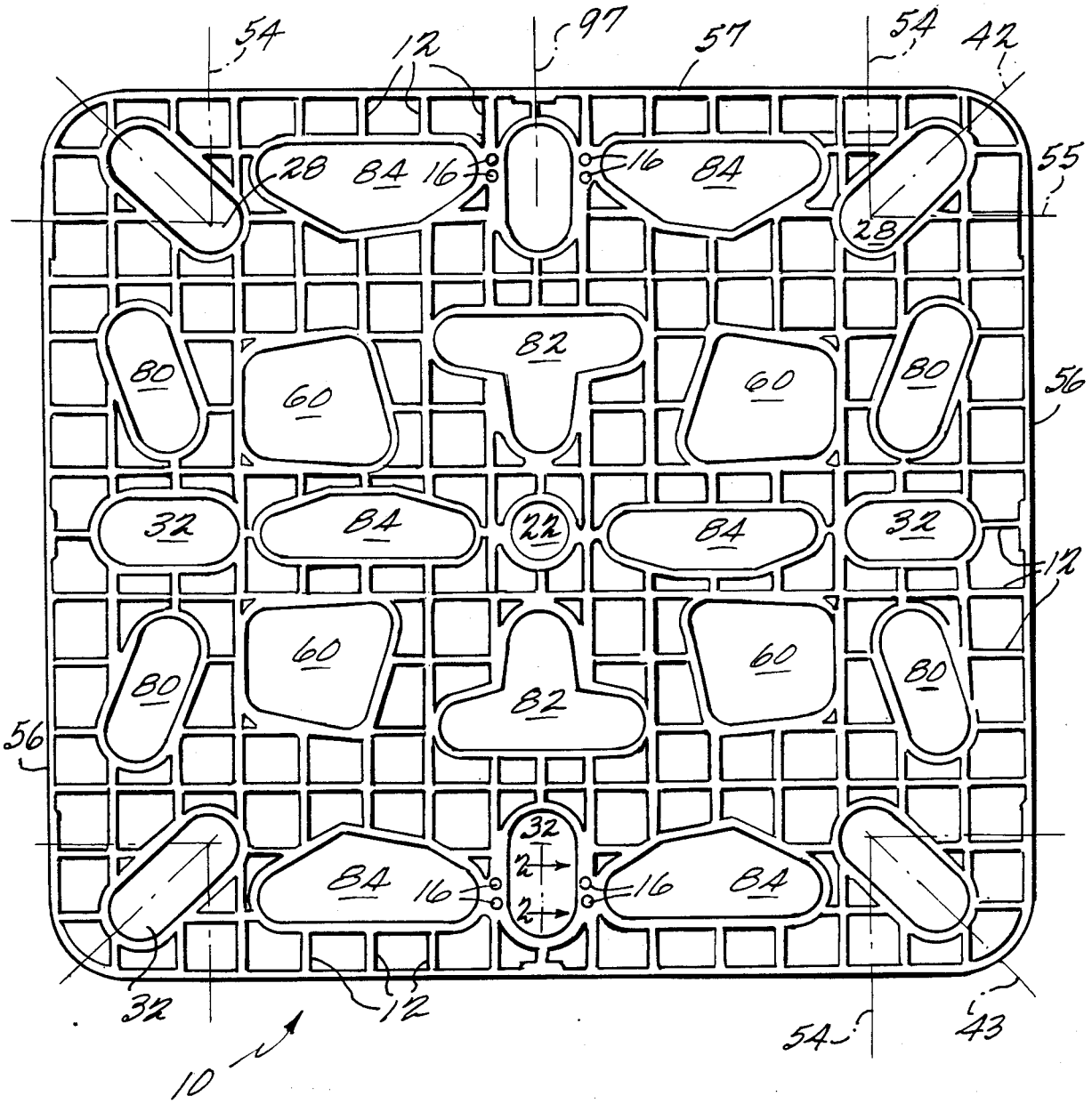
FIG. 1 is a top plan view of the divider in accordance with the present invention.
Figure 3:
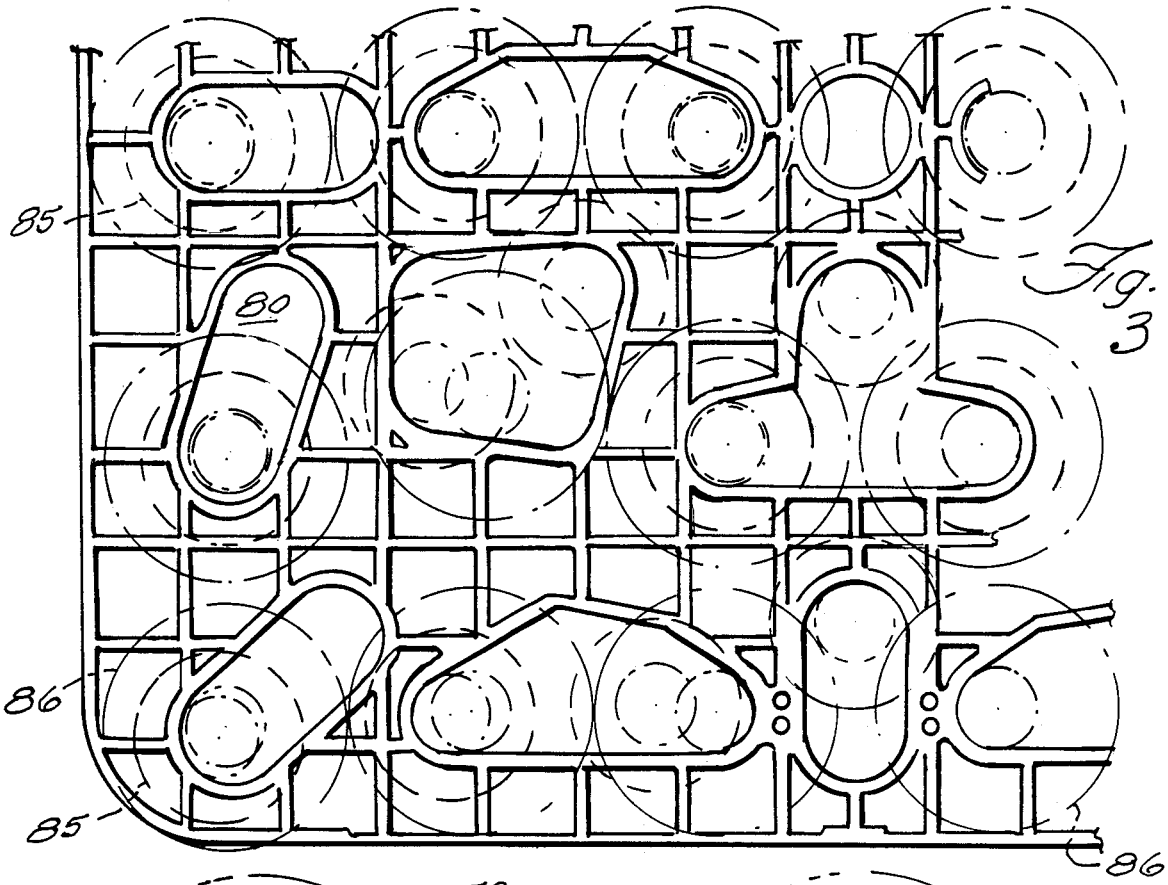
FIG. 3 is a partial plan view of the FIG. 1 divider showing in phantom lines a preferred manner in which two different yarn spool product sizes could be arranged thereon.

A particularly important feature of the present invention resides in the symmetrical groupings of apertures defined in divider 10 which accommodate various yarn spool product sizes in a manner which will now be described in greater detail. As briefly mentioned above, nominal yarn spool diameters are typically 5, 7, 9, 12 and 14 inches and such diameters have been shown in phantom line in FIGS. 3–5. However, the reader should appreciate that other yarn spool diameters could be conveniently accommodated by divider 10. For the discussion which follows, the reader may also wish to periodically refer to FIG. 1 wherein the relative aperture sizing, shapes, and groupings are shown in detail.

Figure 5:
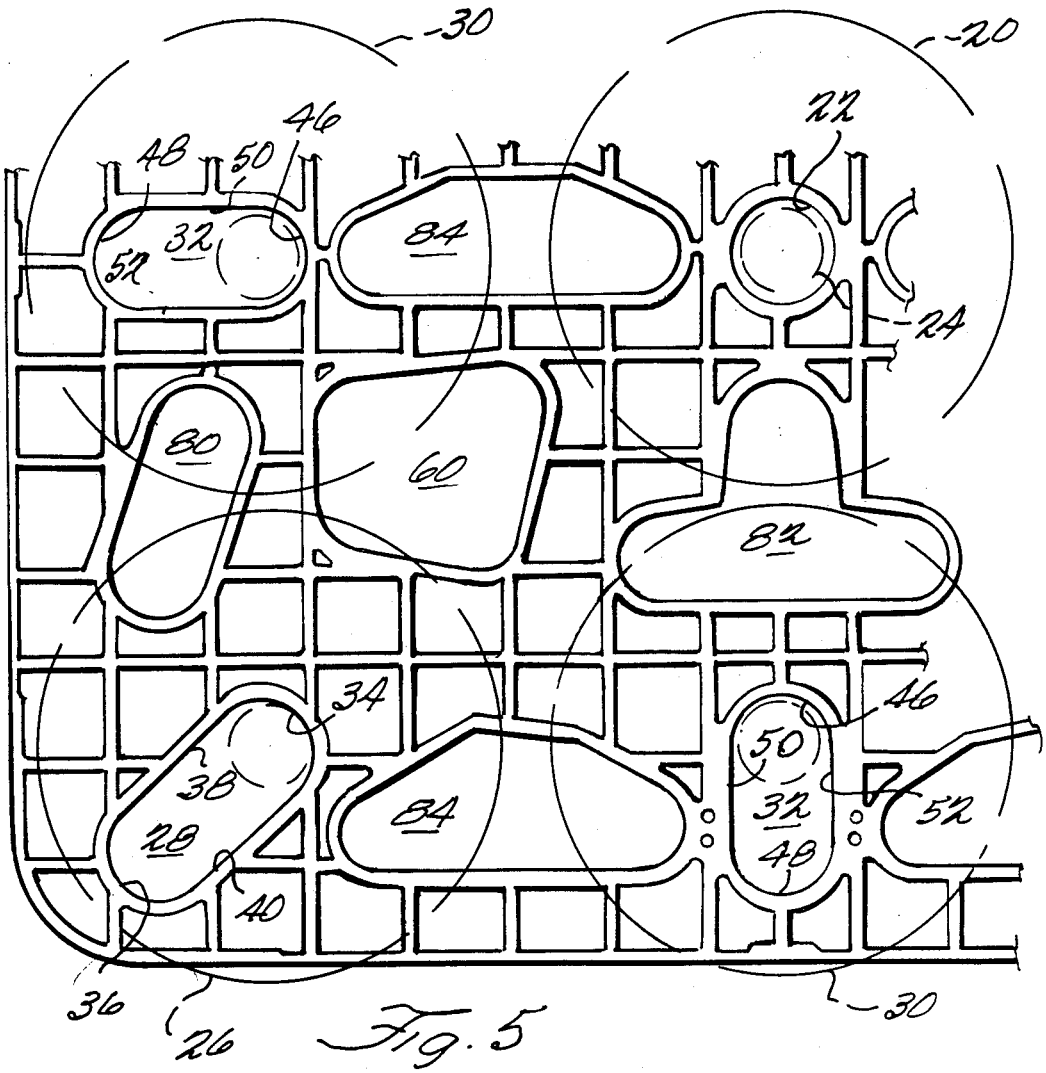
FIG. 5 is a partial plan view of the FIG. 1 divider showing yet another preferred manner in which a different yarn spool product size can be arranged thereon.

The nominal 14 inch diameter yarn spool, for example, is shown in phantom line in FIG. 5. As can be seen, a central spool 20 is accommodated by central arcuate opening 22 which accepts the bottom portion of core member 24 therein. Corner spool 26 is accommodated by one of a first grouping of apertures 28 while intermediate spools 30 are accommodated by a second grouping of apertures 32 (only a portion of the first and second grouping of apertures 28 and 32, respectively, are shown in FIG. 5).

Each of apertures 28 is defined by a pair of opposing arcuate surfaces 34, 36 separated by a pair of opposing parallel side surfaces 38, 40 thereby providing a substantially elongated appearance thereto. Such elongation permits the core members of various yarn spool diameters to be situated anywhere between opposing surfaces 34, 36. The axis of elongation of apertures 28 is angularly disposed so as to be oriented in a direction towards opening 22 and thus, for all intents and purposes, substantially coincides with an associated one of radial axes 42, 43 from the center of opening 22. To ensure symmetry, radial axes 42 are preferably mutually perpendicular to one another.

Each of apertures 32 is also elongated in nature and is defined by opposing arcuate surfaces 46,48 separated by a pair of parallel side surfaces 50,52. The center points for each of the radius of curvatuares for arcuate surfaces 34 and arcuate surfaces 46 are aligned in such a manner that a pair of apertures 28 having an intermediate aperture 32 will establish a line 54, 55 parallel to exterior edges 56, 57, respectively, of divider 10.

Figure 4:
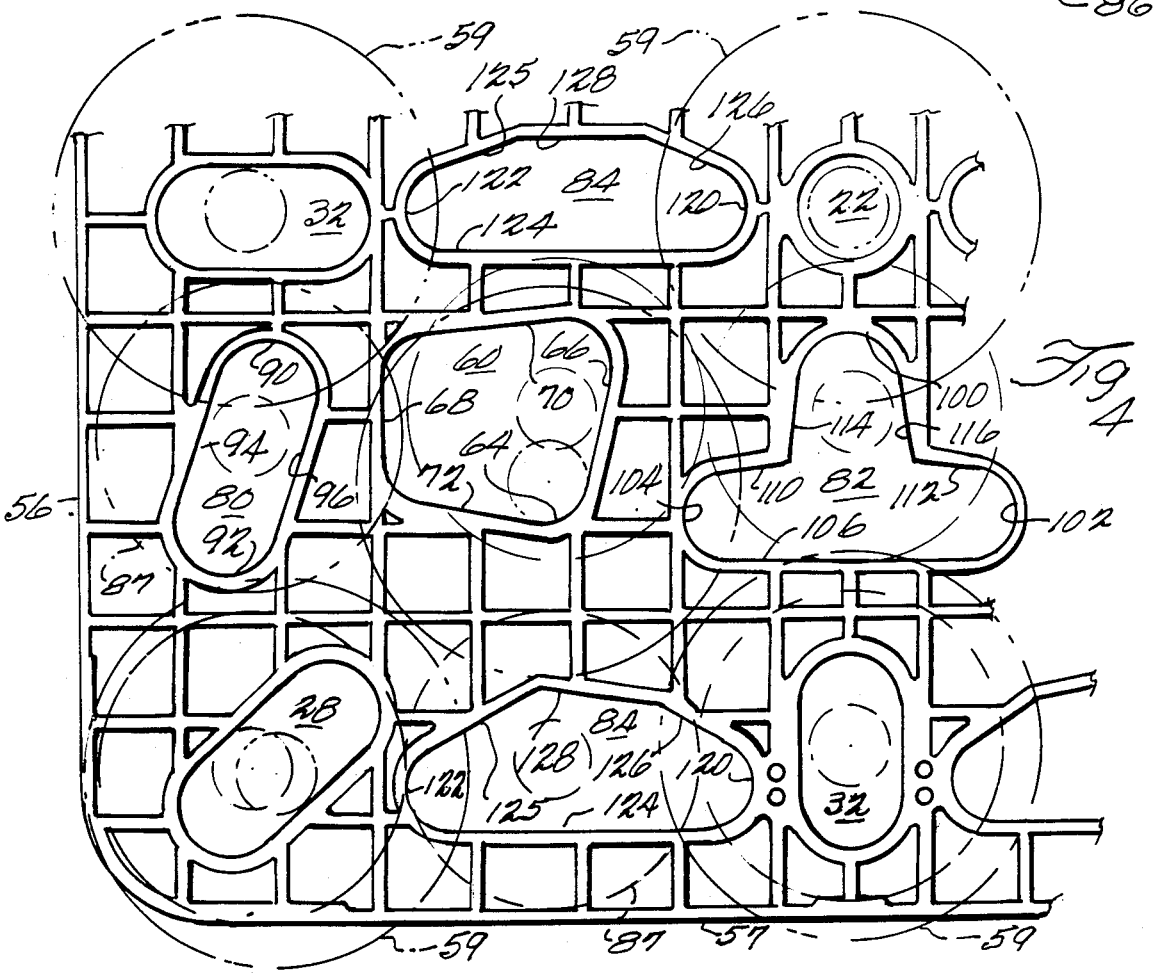
FIG. 4 is a partial plan view of the FIG. 1 divider showing in phantom lines a preferred manner in which two other different yarn spool product sizes could be arranged thereon.
Figure 6:
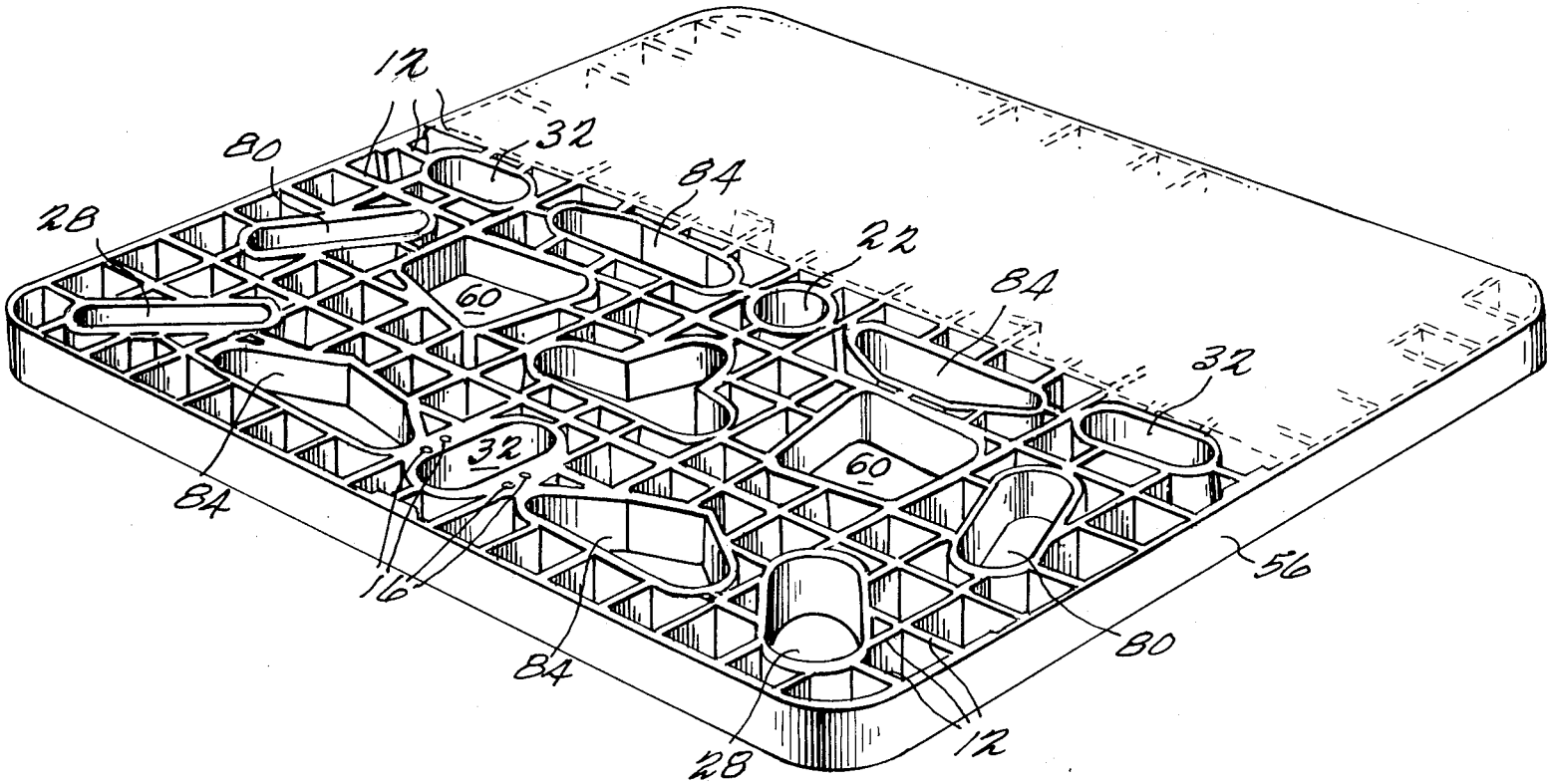
FIG. 6 is a perspective view of the FIG. 1 divider.

To accommodate yarn spools having a nominal 12 inch diameter, for example, central opening 22 and apertures 28,32 are utilized in manner similar to that described above (nominal 12 inch diameter yarn spools are shown in phantom line in FIG. 4 as numeral 59). In addition, a third grouping of apertures 60 is provided to accommodate interior spools. Each of apertures 60 is defined by at least one arcuate surface 64 whose radius of curvature center point substantially coincides with a respective one of radial axes 42, 43 and is situated therealong so as to be substantially midway between central opening 22 and one of apertures 28. Although apertures 60 can be of any desired geometric shape, I presently prefer to provide an inwardly inclined interior edge 66 opposing an exterior edge 68, the latter being substantially parallel to its associated exterior edge 56 or 57 of divided 10. Connecting the interior edge 66 and exterior edge 68 is a pair of side edges 70,72 which are angled in the direction from interior edge 66 towards exterior edge 68 so as to converge thereon. All intersections of edges 66,68,70 and 72 are preferably arcuate or smoothly rounded.

To accommodate yarn spools having nominal diameters of less than 12 inches, for example, fourth, fifth and sixth groupings of apertures 80,82 and 84, respectively, are utilized so as to maximize the versatility of divider 10. Nominal yarn spool diameters of, for example, 5 and 7 inches are shown by phantom lines in FIG. 3 as numerals 85 and 86, respectively, while a nominal 9 inch diameter yarn spool is shown by phantom line in FIG. 4 as numeral 87.

The fourth grouping of apertures 80 is substantially similar to the first grouping of apertures 28 in that opposing arcuate surfaces 90,92 are separated from one another by an opposing pair of parallel side surfaces 94,96. Each arcuate surface 90 of apertures 80 is preferably interiorly offset with respect to arcuate surface 92 so that side surfaces 94,96 form an angle of about 18° relative to its respective side edges 56.

The fifth grouping of apertures 82 includes a pair of T-shaped openings symmetrically arranged on each side of central opening 22 along bisecting axis 97 substantially midway between respective apertures 32 and central opening 22. Each of the apertures 82 include a front arcuate surface protion 100 whose centerpoint substantially coincides with axis 97, and opposing rear arcuate surface portions 102, 104, the respective centerpoints of which coincide with a line parallel to exterior edges 57. The rear arcuate portions 102,104 are connected to one another by sidewall 106 which is also preferably parallel to exterior edges 57. Furthermore, diverging edges 110,112 connect arcuate portion 100 with edges 114,116, respectively, so as to establish the continuous perimetrical edge of aperture 82. Edges 114,116 could, if desired, be parallel to one another rather than diverging and, in addition, edges 110,112 could be parallel to exterior edges 57.

The sixth grouping of apertures 84 includes opposing arcuate surfaces 120,122 whose respective centerpoints coincide with a line parallel to exterior edges 57, and are preferably connected to one another by sidewall 124 which is also parallel to exterior edges 57. Since apertures 84 are utilized to accommodate various diameters of yarn spools, the width of apertures 84 at the central portions thereof should be greater than the diameter of arcuate surfaces 120,122. Thus, apertures 84 could be generally triangularly shaped, but I presently prefer to have edge surfaces 125,126 converge upon connecting edge 128. Thus, the greater width dimension substantially in the central portion of apertures 84 permit yarn spools having, for example, a nominal diameter of about 9 inches to be interiorly offset with respect to the line which coincides with the conterpoints of arcuate surfaces 120,122 (see numeral 87 in FIG. 4). Additionally, even smaller diameter yarn spools could be accommodated by apertures 84 (see FIG. 3).

As the reader should now appreciate, the present invention provides significant advantages over known separators typically utilized in the packaging of yarn spools. Thus, while the present invention has been herein described in what is presently conceived to be the most preferred embodiment thereof, those in the art may appreciate that many modifications may be made hereof, which modifications shall be accorded the broadest scope of the appended claims so as to encompass all equivalent structures and/or devices.

What is claimed is:

1. A divider for separating stacked articles of the type having a support member with filamentary material wrapped on said support member defining a body thereof having opposite ends, said support member having opposite ends and said ends of said body of material being spaced respectively inwardly of said ends of said support member with said divider accommodating various predetermined diameters of said bodies, said divider comprising a substantially rigid planar member defining opposing pairs of exterior edges and including:

means defining an opening substantially centrally disposed in said member;

means defining a first grouping of first elongated apertures having opposing arcuate end surfaces, each of said first apertures being disposed near a respective corner of said member and inwardly angularly oriented towards said opening; and means defining a second grouping of second elongated apertures having opposing arcuate end surfaces, each of said second apertures being disposed in said member substantially midway between respective pairs of said first apertures, the axis of elongation of said second apertures being in substantial alignment with one of the mutually perpendicular bisecting axes of said member;

said apertures extending completely through said rigid planar member so that, when a set of said support members having each a body having a selected diameter is loaded on said rigid member with the respective ends thereof inserted into selected said apertures, adjacent ones of said support members may be moved generally parallel to said planar rigid member to permit a maximum number of said support members to be loaded thereon, said maximum number being dependent on the diameters of said bodies.

2. A divider as in claim 1 wherein said rigid, planar member further includes means defining a third grouping of third apertures, each of said third apertures having an arcuate portion whose radius of curvature centerpoint is substantially aligned with the axis of elongation of opposing pairs of said first apertures, each of said third apertures being disposed intermediate said opening and a respective one of said first apertures.

3. A divider as in claim 2 wherein said rigid, planar member further includes means defining a fourth grouping of fourth elongated apertures having opposing arcuate ends, each of said fourth apertures being disposed between respective ones of said first and second apertures along one of said pairs of opposing exterior edges, each of said fourth apertures being angularly oriented towards said opening.

4. A divider as in claim 3 wherein said rigid, planar member further includes means defining a fifth grouping of generally T-shaped apertures having arcuate end portions, each of said generally T-shaped apertures being disposed in said member intermediate a respective one of said second apertures and said opening such that one of said arcuate end portions of said generally T-shaped aperture is aligned with one of said bisecting axes while a line intersecting the centerpoints of the two remaining arcuate end portions of said generally T-shaped aperture is substantially perpendicular to said one of said bisecting axes.

5. A divider as in claim 4 wherein said rigid, planar member further includes means defining a sixth grouping of sixth apertures each being disposed in said member intermediate respective ones of said first and second apertures or intermediate a respective one of said second apertures and said opening, each of said sixth apertures being defined by opposing arcuate end portions and sidewall means connecting said opposing arcuate end portions and for establishing a width in the central portion of each of said sixth apertures greater than the diameter of said opposing arcuate end portions.

6. A divider as in claim 1 wherein said rigid, planar member further includes stacking means permitting said divider to be contiguously nested with similar ones of said divider and for preventing relative movement between adjacent ones of said dividers when in said nested relationship.

7. A divider as in claim 6 wherein said stacking means comprises means defining raised areas on one surface of said member, and means defining recessed areas on the other surface of said member, said raised areas defined on said member registrable with said recessed areas defined on another said member to permit said one member and said other member to be nested.

8. A divider as in claim 7 wherein said raised area defining means defines convex raised surfaces.

9. A divider as in claim 8 wherein said recessed area defining means defines concave recessed surfaces.

10. A divider as in claim 1 or 9 wherein said rigid, planar member further includes interconnecting means defining a grid-like array of rigid rib members for rigidly interconnecting said aperture defining means.

11. A divider as in claim 10 wherein said interconnecting means defines a grid-like array of vertically planar rigid rib members.

12. A divider for separating stacked articles of the type having a support member with filamentary material wrapped on said support member defining a body thereof having opposite ends, said support member having opposite ends and said ends of said body of material being spaced respectively inwardly of said ends of said support member with said divider accommodating various predetermined diameters of said bodies of said material, said divider comprising a substantially rigid planar member defining opposing pairs of exterior edges and including:

means defining an opening substantially centrally disposed in said member;

means defining a first grouping of first elongated apertures having opposing arcuate end surfaces, each of said first apertures being disposed near a respective corner of said member and inwardly angularly oriented towards said opening;

means defining a second grouping of second elongated apertures having opposing arcuate end surfaces, each of said second apertures being disposed in said member substantially midway between respective pairs of said first apertures, the axis of elongation of said second apertures being in substantial alignment with one of the mutally perpendicular bisecting axes of said member; and means defining a grouping of generally T-shaped apertures having arcuate end portions, each of said generally T-shaped apertures being disposed in said member intermediate a respective one of said second apertures and said opening such that one of said arcuate end portions of said generally T-shaped apertures is aligned with one of said bisecting axes while a line intersecting the centerpoints of the two remaining arcuate end portions of said generally T-shaped apertures is substantially perpendicular to said one of said bisecting axes;

said apertures extending completely through said rigid planar member so that, when a set of said support memebers having each a body having a selected diameter is loaded on said rigid member with the respective ends thereof inserted into selected said apertures, adjacent ones of said support members may be moved generally parallel to said planar rigid member to permit a maximum number of said support members to be loaded thereon, said maximum number being dependent on the diameters of said bodies.

13. A divider as in claim 12 wherein said member is formed of an array of vertically planar interconnecting ribs.

* * * * *